United States Patent [19]

Motyka et al.

[11] Patent Number: 4,725,818

[45] Date of Patent: Feb. 16, 1988

[54] WALK THROUGH TEST SYSTEM

[75] Inventors: Charles J. Motyka, Gardner; Lawrence Kaplan, Greenfield; Henry F. Harrington; Rudolph B. Young, both of Gardner, all of Mass.

[73] Assignee: Simplex Time Recorder Co., Gardner, Mass.

[21] Appl. No.: 775,854

[22] Filed: Sep. 13, 1985

[51] Int. Cl.[4] ..... G08B 29/00

[52] U.S. Cl. ..... 340/514; 340/508; 340/692; 340/384 E

[58] Field of Search ..... 340/514, 502, 503, 504, 340/506, 507, 508, 512, 513, 515, 516, 525, 534, 825.05, 691, 384 E, 384 R; 367/197–199; 181/19

[56] References Cited

U.S. PATENT DOCUMENTS

| | | | |
|---|---|---|---|
| 276,708 | 5/1883 | Pelisse . | |
| 277,836 | 5/1883 | Flammger et al. . | |
| 3,231,879 | 1/1966 | Kramer et al. . | |
| 3,252,156 | 5/1966 | Muehter | 340/514 |
| 3,422,252 | 1/1969 | Cooper, Jr. . | |
| 3,448,447 | 6/1969 | Tetherow . | |
| 3,452,345 | 6/1969 | Kinsey . | |
| 3,552,350 | 1/1971 | Ranney et al. . | |
| 3,562,730 | 2/1971 | Hill et al. . | |
| 3,570,446 | 3/1971 | Buford et al. . | |
| 3,611,362 | 10/1971 | Scott | 340/513 |
| 3,619,728 | 11/1971 | Cooper, Jr. . | |
| 3,623,087 | 11/1971 | Gallichotte et al. . | |
| 3,627,993 | 12/1971 | Cooper, Jr. . | |
| 3,665,462 | 5/1972 | Seaton et al. . | |
| 3,717,862 | 2/1973 | Sasaki . | |
| 3,821,733 | 6/1974 | Reiss et al. . | |
| 3,848,241 | 11/1974 | Le Nay . | |
| 3,886,534 | 5/1975 | Rosen et al. . | |
| 3,919,528 | 11/1975 | Cooper et al. . | |
| 3,927,404 | 12/1975 | Cooper . | |
| 3,928,849 | 12/1975 | Schwartz . | |
| 3,930,246 | 12/1975 | Campbell . | |
| 3,938,118 | 2/1976 | Galvin et al. . | |
| 3,955,183 | 5/1976 | McBrian . | |
| 3,968,182 | 7/1976 | Inoue et al. . | |
| 4,032,909 | 6/1977 | Boyce | 340/214 |
| 4,044,351 | 8/1977 | Everson . | |
| 4,064,507 | 12/1977 | Schmitz | 340/384 E |
| 4,095,212 | 6/1978 | Pruitt . | |
| 4,117,479 | 9/1978 | Galvin et al. . | |
| 4,141,006 | 2/1979 | Braxton . | |
| 4,151,514 | 4/1979 | Haynes | 340/384 E |
| 4,201,982 | 5/1980 | Humphries | 340/514 |
| 4,245,296 | 1/1981 | Small et al. . | |
| 4,257,035 | 3/1981 | Yen | 340/384 E |
| 4,270,121 | 5/1981 | Verr . | |
| 4,274,087 | 6/1981 | Swanson . | |
| 4,286,208 | 8/1981 | French et al. . | |
| 4,321,592 | 3/1982 | Crandall et al. . | |
| 4,322,631 | 3/1982 | Spofford . | |
| 4,323,890 | 4/1982 | Lemke . | |
| 4,342,985 | 8/1982 | Desjardins . | |

(List continued on next page.)

*Primary Examiner*—Donnie L. Crosland

*Attorney, Agent, or Firm*—Siedel, Gonda, Goldhammer & Abbott

[57] ABSTRACT

Walk through test system for testing devices such as pull stations, smoke detectors, alarm bells and the like for alarm and trouble conditions without the assistance of a central panel operator. The devices are connected in a loop or loops distributed throughout one or more zones remote from a central panel. Alarm and trouble conditions are detected at the central panel. When a device is placed in alarm by the workman, a coded alarm is sounded which is aurally detectable by the workman at the location of the device, remote from the central panel. The coded alarm identifies the zone loop in which the device is connected. When a trouble condition is created in a loop by the workman, an alarm is sounded which is aurally detectable at the location of the loop, remote from the central panel. The alarm is coded to indicate to the workman that a trouble condition has been detected at the central panel. A device which has been placed in alarm is automatically reset by the central panel after the coded alarm has been sounded, so that the next device can be tested.

9 Claims, 4 Drawing Figures

U.S. PATENT DOCUMENTS 4,345,459 8/1982 Perry et al. .
4,349,812 9/1982 Healey et al. .
4,361,031 11/1982 Perry et al. .
4,370,566 1/1983 Perry et al. .
4,384,477 5/1983 Perry .
4,398,168 8/1983 Smith .
4,400,685 8/1983 Chestnut .
4,406,995 9/1983 May .
4,412,211 11/1983 Lautzenheiser et al. ..... 340/514
4,412,750 11/1983 Schuder et al. .
4,467,423 8/1984 Smith et al. .
4,481,502 11/1984 Dawson ..... 340/516
4,489,312 12/1984 Yoshizaki .
4,498,074 2/1985 Saski .
4,498,075 2/1985 Gaudio ..... 340/525
4,517,554 5/1985 Moser et al. .

ZONE 1 ALARM
ZONE 2 ALARM
ZONE 3 ALARM
ZONE 4 ALARM
32a
32b
32c
32d
+5V
+5V
0V
+24V
+24V
ALARM RELAY
34
36
40
K1
K2
TROUBLE RELAY
0V
-P
+P
38
44
TEST SW3
+1.5V
+24V
TBL REF
46a
46b
+10V
+5V
47
BELL TBL
+24V
+6V
K1C
K1C'
VRDC(+24V)
42
TBL
0V
SW4
TROUBLE SILENCE
+5V
0V
+24V
K4C
0V
ZONE 1
ZONE 2
ZONE 3
ZONE 4
K2
48
+24V

WALK THROUGH TEST SYSTEM

BACKGROUND OF THE INVENTION

The present invention is directed to a technique for testing devices such as pull panels, smoke detectors and the like seriatim for alarm and trouble conditions. Normally, such devices are connected in loops in a manner well-known to the artisan and are monitored for alarm and trouble conditions at a central panel. The loops are distributed throughout the zones of an industrial plant, office or residential building, or the like, remote from the central panel. A tone alarm is provided at the central panel to announce to the central panel operator that a trouble condition has been detected. Zone trouble LEDs at the central panel visually identify the zone in which the trouble condition has been detected. Alarm bells distributed throughout the zones are sounded continuously when an alarm condition is detected. Zone alarm LEDs are located at the central panel to visually identify the zone in which the alarm condition has been detected.

To perform a walk through test of each device, a workman places each device in an alarm condition and creates a trouble condition in the loop connection to the device. The workman must communicate with the central panel operator to determine whether the trouble condition has been properly detected at the central panel since the audible alarm indicating a trouble condition is only sounded at the central panel. In addition, although the workman need not communicate with the central panel operator to determine whether an alarm condition has been properly detected at the central panel, he must communicate with the central panel operator to determine whether the device has been connected in the correct zone loop. Thus, visual identification of the zone loop in which the device in alarm is connected is provided only by the zone alarm LED at the central panel. A device which is physically located in one zone should cause the zone alarm LED for the loop in that zone (and no other) to light up at the central panel. If another zone alarm LED lights up instead, this indicates that the device has either been connected in the wrong zone loop or physically located in the wrong zone.

Moreover, in the conventional system, after a device has been placed in an alarm condition by the workman, the device must be reset by depression of an alarm reset button at the central panel before the next device can be tested. The central panel operator must perform this function. In light of the foregoing, it can be appreciated that in the conventional system the workman cannot rapidly test a multitude of devices distributed throughout the zones of a plant, building or the like without the cooperation of an operator at the central panel.

The problem solved by the present invention is that of providing a rapid walk through test of a multitude of devices distributed throughout various zones of a plant, building or the like without any communication between the workman and the central panel.

BRIEF SUMMARY OF THE INVENTION

Apparatus for testing devices distributed throughout one or more zone loops remote from a central panel, comprising means at the central panel for monitoring each of said devices in a test mode for an alarm condition, sounding means for sounding an alarm which is aurally detectable immediately at the location of each of said zone loops, and means at the central panel for detecting a device in an alarm condition and for automatically causing said sounding means to sound an alarm which is coded so as to identify the zone loop in which said device in said alarm condition is connected.

DETAILED DESCRIPTION OF THE INVENTION

Figure 1A:
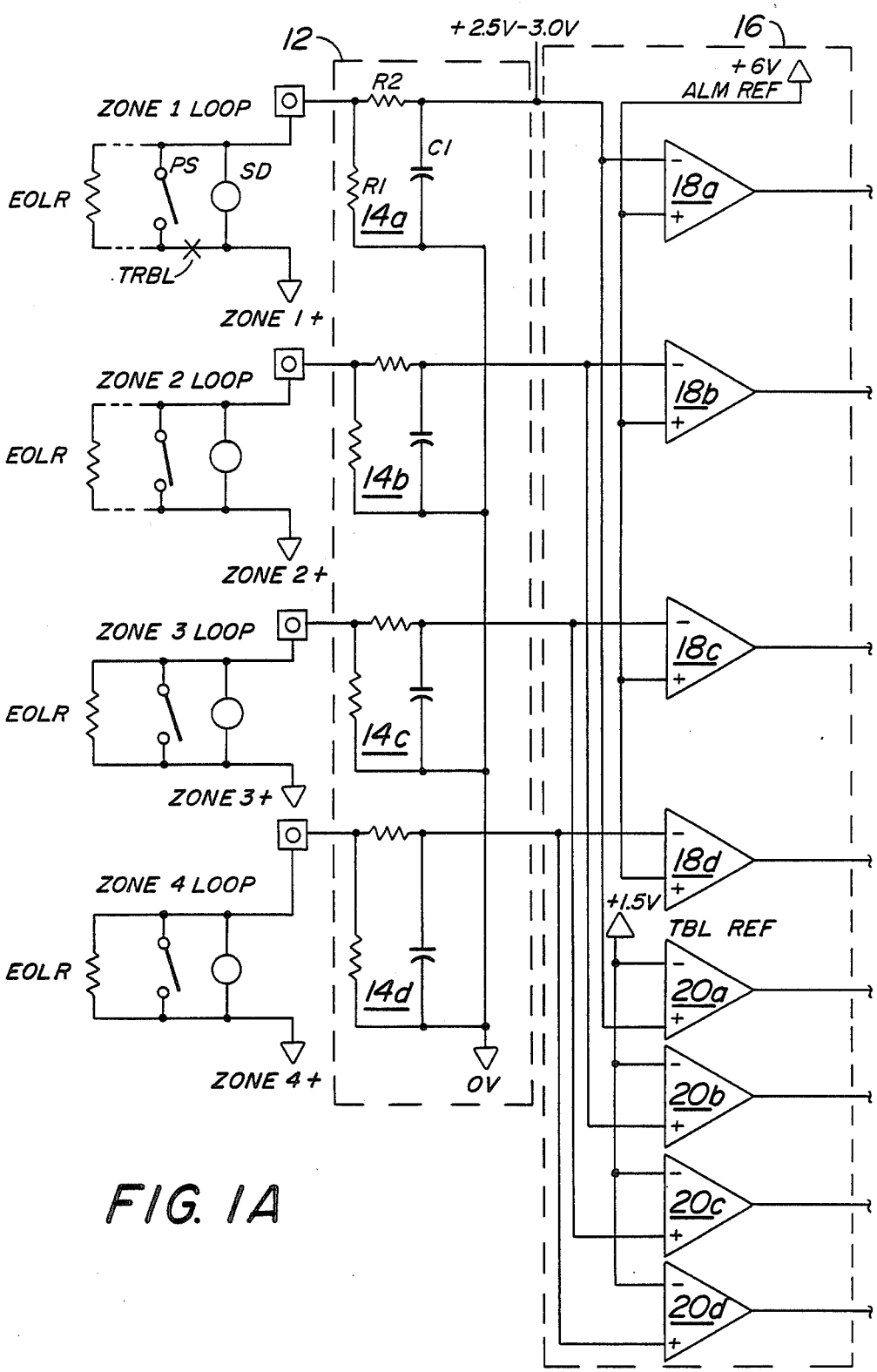
FIGS. 1A, B and C comprise a schematic of the central panel for the walk through test system of the present invention.
Figure 1B:
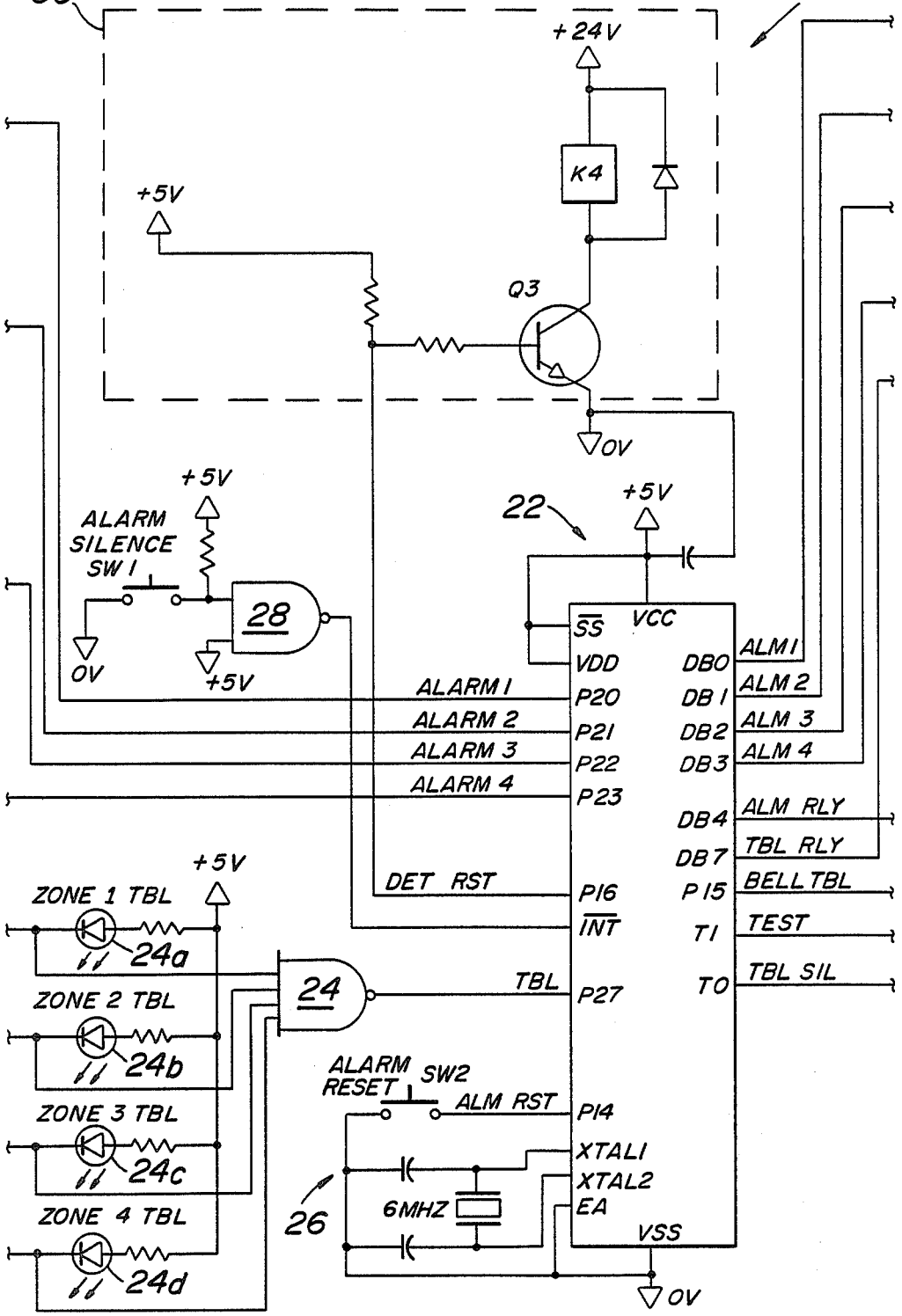
Figure 1C:
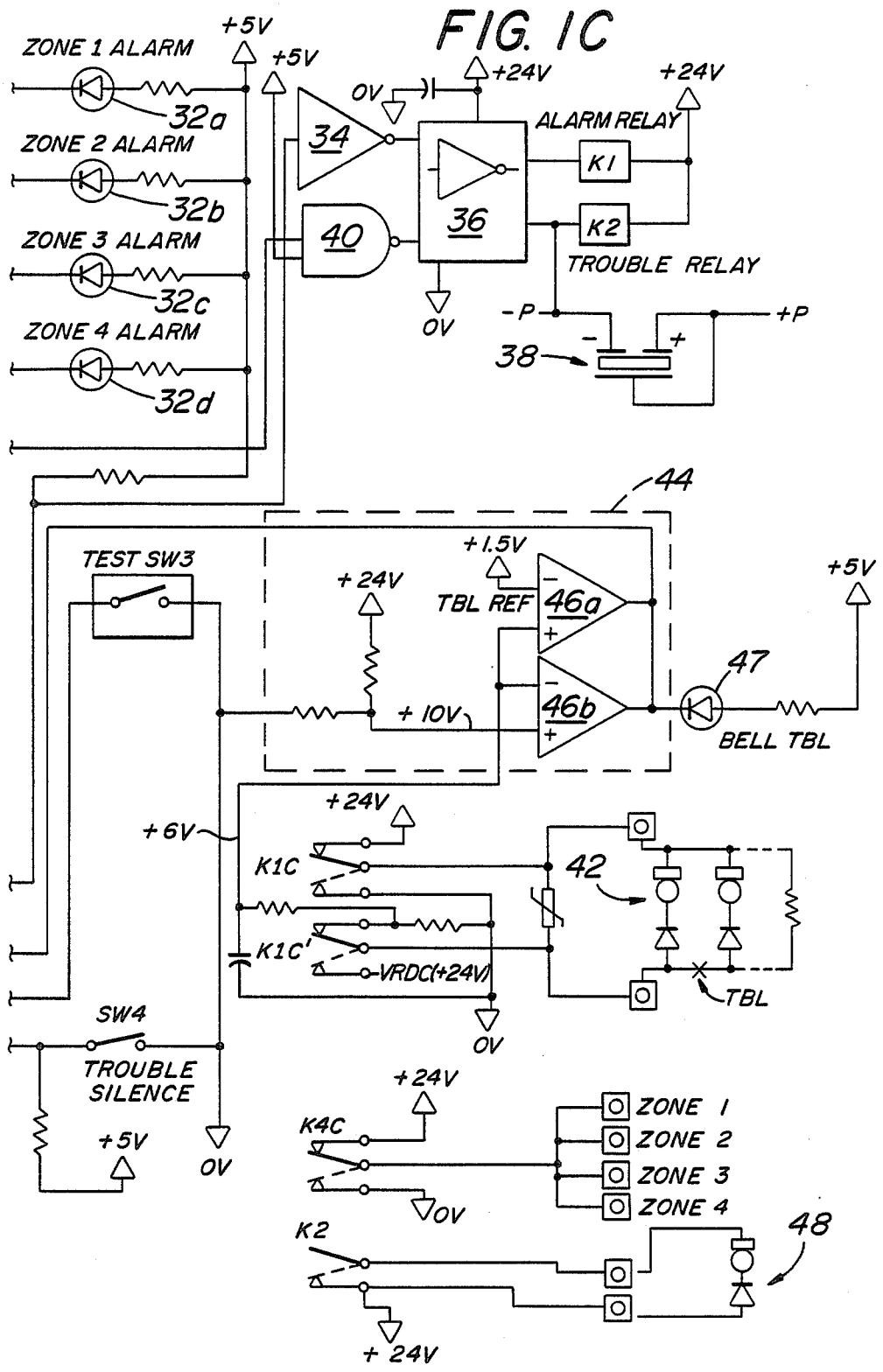

Referring to the drawings, wherein like numerals indicate like elements, there is shown in FIGS. 1A–C the central panel for the walk through test system of the present invention, designated generally as 10. The panel includes a monitor circuit 12 comprising identical R-C networks **14*a*, 14*b*, 14*c*, 14*d*. Each R-C network includes resistors R1, R2 and capacitor C1. Each R-C network is connected to an electrical loop ("zone loop") terminating in an end of line resistor (EOLR). Various devices such as smoke detectors (SD), pull panels (PS) and similar on/off devices are connected in parallel in the loop. Each loop is associated with and located in a particular zone in the plant, building or the like, remote from the central panel. The types and number of devices connected in each zone loop may vary as is well-known to the artisan. As shown in FIG. 1A, there are four zones, hence four zone loops, but the number of zones will vary from application to application. There will be one R-C network in monitor circuit 12** for each zone loop.

Each R-C network is connected to a pair of comparators in an alarm/trouble detect circuit 16 at the central panel. Each of the comparators in circuit 16 is an LM 339A comparator. R-C network **14*a* is connected to alarm comparator 18*a* and trouble comparator 20*a*. R-C network 14*b* is connected to alarm comparator 18*b* and trouble comparator 20*b*. R-C network 14*c* is connected to alarm comparator 18*c* and trouble comparator 20*c*. R-C network 14*d* is connected to alarm comparator 18*d* and trouble comparator 20*d***. Each of the lines connecting the RC networks to their associated alarm and trouble comparators normally rests at 2.5 v–3 v.

Alarm comparators **18*a*, 18*b*, 18*c* and 18*d* are connected at their inputs to a +6 v alarm reference threshold (ALM REF). Trouble comparators 20*a*, 20*b*, 20*c* and 20*d* are connected at their inputs to a +1.5 v trouble reference threshold (TBL REF). The outputs of the alarm comparators 18*a*, 18*b*, 18*c* and 18*d* are connected to the inputs of a type 8748 microprocessor 22 at the central panel. See FIG. 1B. The outputs of the trouble comparators 20*a*, 20*b*, 20*c*, 20*d* are combined at NAND gate 24, and the output of the NAND gate is fed to the microprocessor. The NAND gate performs an OR logic function. The outputs of the trouble comparators 20*a*, 20*b*, 20*c*, 20*d* also control the zone 1–4 trouble LEDs 24*a*, 24*b*, 24*c*, 24*d***. These LEDs provide a visual indication at the central panel of the particular zone in which a trouble condition is detected.

Microprocessor 22 is connected to a master clock circuit 26 comprising a 6 Mhz crystal. The interrupt input ($\overline{INT}$) of the microprocessor is connected to an alarm silence switch SW1 via a NAND gate 28. An alarm reset switch SW2 is connected to another input of the microprocessor. A test switch SW3 is connected to another input of the microprocessor. See FIG. 1C. And a trouble silence switch SW4 is connected to a further input of the microprocessor. Operation of each of these switches is monitored by the microprocessor as explained in detail hereafter.

The microprocessor controls a zone power circuit 30 at the central panel. See FIG. 1B. The zone power circuit comprises a 2N4401 transistor Q3 having a relay K4 connected in its collector circuit. Relay K4 controls contacts K4C which, in the normal condition as shown in solid lines in FIG. 1C, provide +24 v to the loops in zones 1–4.

The microprocessor 22 controls the zone 1–4 alarm LEDs 32*a*, 32*b*, 32*c*, 32*d* based on the outputs of the alarm comparators 18*a*, 18*b*, 18*c*, 18*d* respectively. See FIG. 1C. The microprocessor also controls an alarm relay K1 at the central panel via invertor 34 and ULN2803A driver 36, as well as a trouble relay K2 and a piezo electric tone alarm 38 via NAND gate 40 and driver 36.

The alarm relay K1 controls the alarm contacts K1C, K1C′ which operate the alarm bells 42. The alarm bells are unipolar devices connected as shown in FIG. 1C throughout zones 1–4 remote from the central panel. The alarm bells provide an audible alarm in all zones when an alarm condition is detected in any zone. The alarm bells themselves are monitored for trouble conditions (open circuit between adjacent alarm bells or short circuit across an alarm bell) by alarm bell monitor circuit 44. The alarm bell monitor circuit 44 includes a pair of LM339A comparators 46*a*, 46*b* which are connected to an input of the microprocessor 22. Comparator 46*a* is connected to the +1.5 v trouble reference threshold. Comparator 46*b* is connected to a +10 v trouble reference threshold. The other inputs of the comparators 46*a*, 46*b* are connected together and normally rest at +6 v when contacts K1C, K1C′ are in the positions shown in solid lines in FIG. 1C (no alarm condition). The output of comparators 46*a*, 46*b* are connected together to an alarm bell trouble LED 47. If an open circuit occurs between adjacent alarm bells, as indicated by the "X" and designation "TBL" in FIG. 1, the +6 v line drops below the +1.5 v threshold and comparator 46*a* causes alarm bell trouble LED 47 to light up at the central panel. Similarly, if a short circuit occurs across any alarm bell, the +6 v line rises above the +10 v threshold and comparator 46*b* causes the alarm bell trouble LED to light up. In addition, when either comparator causes the alarm bell trouble LED to light up, the outputs of the comparators are detected by the microprocessor on the BELL TBL input line. In response, the microprocessor activates trouble relay K2 and tone alarm 38 via the TBL RLY output, NAND gate 40 and driver 36.

When the central panel 10 is operating normally (not in test mode) to monitor the devices in zones 1–4 for alarm and trouble conditions, test switch SW3 is in the open position shown in FIG. 1C. Alarm silence switch SW1, alarm reset switch SW3 and trouble silence switch SW4 are also in the open positions as shown in FIGS. 1B and C. Relay contacts K4C are in the solid line position shown in FIG. 1C so that +24 v is supplied to the loops in zones 1–4. The trouble relay contacts K2 are in the solid line position shown in FIG. 1C. These contacts are connected to a single trouble bell 48 located at or close to the central panel so as to provide a second audible indication of the detection of a trouble condition to the central panel operator.

An alarm condition occurs when any of the devices PS, SD present a short across the zone loop lines. R-C networks 14*a*, 14*b*, 14*c*, 14*d* operate identically in detecting an alarm condition. For example, if any of the devices in the zone 1 loop go into alarm condition, the output of associated RC network 14*a* rises towards +24 v, exceeding the +6 v alarm reference threshold and triggering alarm comparator 18*a*. The output of the alarm comparator changes state. Microprocessor 22 detects the change in output of comparator 18*a* at the ALARM1 input line and activates the zone 1 alarm LED 32*a* at the central panel via the ALM1 output line. In addition, the microprocessor trips the alarm relay K1 via the ALM RLY output line, invertor 34 and driver 36. Relay contacts K1C, K1C′ therefore transfer to the phantom position shown in FIG. 1C whereby the alarm bells 42 are activated in unison by +24 v of unregulated dc (VRDC). To silence the alarm bells, the central panel operator must depress (close) the alarm silence switch SW1. This changes the output of NAND gate 28, and the change in output is detected at the INT input to the microprocessor. In response, the ALM RLY output of the microprocessor changes condition so as to deactivate the alarm relay K1. Relay contacts K1C, K1C′ transfer back to the solid line position in FIG. 1C so as to deactivate the alarm bells 42.

To reset the device which is in alarm, for example a device in the zone 1 loop as discussed herein, the central panel operator must depress (close) the alarm reset switch SW2. This grounds the ALM RST input to the microprocessor, and the microprocessor changes the state of the DET RST output line for a preset period of time such as five seconds in response. This cuts off transistor Q3 and deenergizes relay K4 for five seconds. Relay contacts K4C therefore transfer to the phantom position shown in FIG. 1C thereby grounding all zone loops. This resets the device in alarm. After the preset (five second) period of time, the microprocessor restores the DET RST output to its initial state, thereby turning on transistor Q3 and energizing relay K4 so that relay contacts K4C transfer back to the solid line position shown in FIG. 1. This restores +24 v power to the zone loops.

A trouble condition is indicated by an open circuit in any of the loop legs which interconnect adjacent devices in the loop. Such a condition is schematically represented in the zone 1 loop by an "X" marked "TBL". See FIG. 1A. A trouble condition opens the loop so that the output line of the R-C network 14*a* drops below the +1.5 v trouble reference threshold. This triggers comparator 20*a*, and the output of the comparator changes state so as to change the output of NAND gate 24. The change in the NAND gate output is detected at the TBL input of the microprocessor, and the microprocessor activates trouble relay K2 and tone alarm 38 in response via the TBL RLY output, NAND gate 40 and driver 36. The trouble relay contacts K2 transfer to the phantom position shown in FIG. 1C so as to activate the trouble bell 48 at the central panel as well.

To silence the trouble bell and the tone alarm, at the central panel, the central panel operator must depress (close) the trouble silence switch SW4. This grounds the TBL SIL input to the microprocessor, and the microprocessor changes the TBL RLY output back to its initial state so as to deactivate the TBL relay K2, tone alarm 38, and trouble bell 48.

The foregoing description represents the conventional central panel operations wherein no zone loop identification is provided at the location of a zone when a zone device goes into alarm and wherein no trouble condition detection is indicated at the location of a zone. If a workman wished to perform a walk through test of all zone loop devices seriatim, testing each device for alarm and trouble conditions, the workman would have to communicate with the central panel operator to confirm zone loop identification during an alarm condition and trouble detection during a trouble condition. The present invention permits the workman to perform the walk through test rapidly, without the assistance of a central panel operator.

Figure 2:
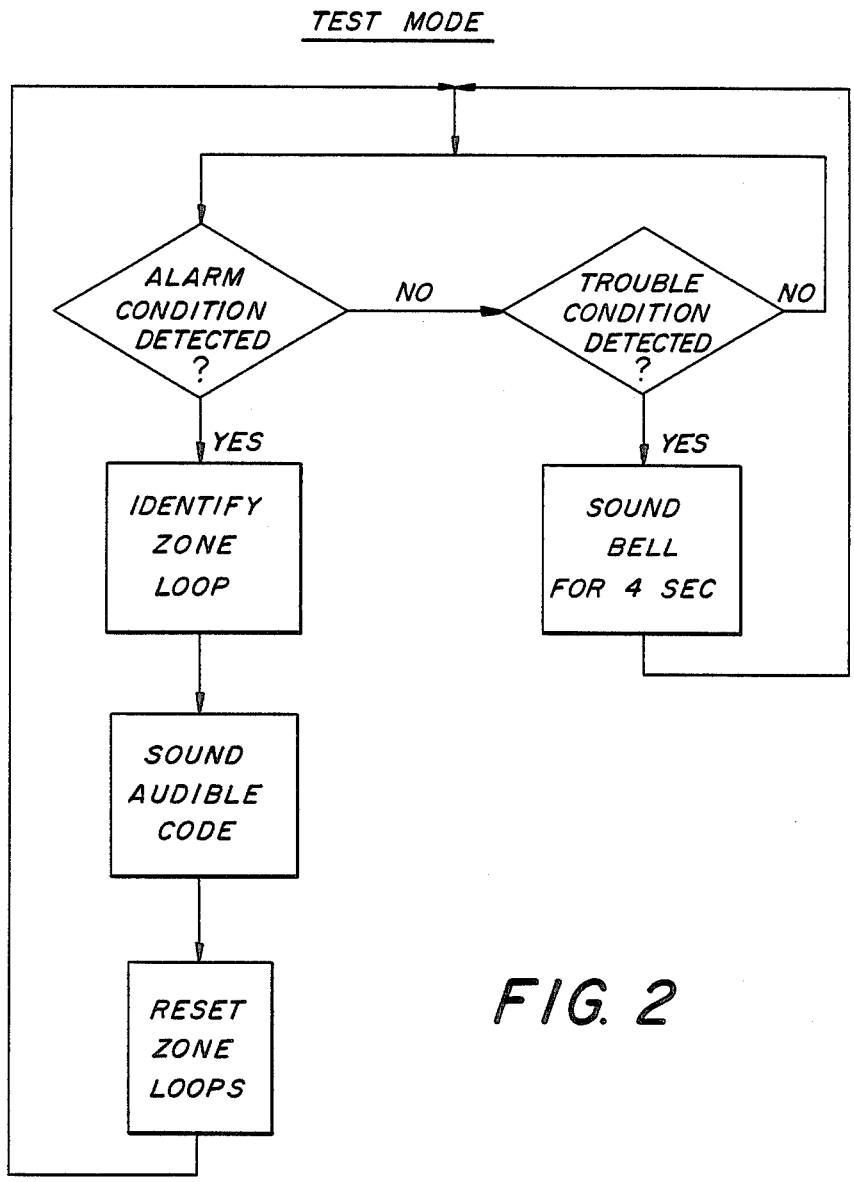
FIG. 2 is a flow chart showing operation of the system in the test mode.

The invention includes provision of the test switch SW3 and programming of the microprocessor as indicated in FIG. 2. To place the system in the test mode, the workman must depress (close) test switch SW3 at the central panel. This grounds the TEST input to the microprocessor, and the microprocessor enters the test mode program routine shown in flow chart form in FIG. 2. In the test mode, the microprocessor first checks the input lines ALARM 1–4 for an alarm condition. If no alarm conditions are detected, the microprocessor checks the TBL and BELL TBL input lines for a trouble condition. If no trouble condition is detected, the microprocessor repeats its check of the ALARM 1–4 lines.

To begin the test, the workman places a device in alarm, for example by blowing smoke into a smoke detector. The alarm condition is detected on one of the ALARM 1–4 lines, corresponding to the zone in which the device is connected. The microprocessor sets a flag which indicates the particular zone loop in which the device in alarm is connected and the microprocessor activates the appropriate ALM 1–4 output line so as to provide a visual identification at the central panel of that zone. The microprocessor then toggles the ALM RLY output line so as to alternately activate and deactivate the alarm relay K1 over preset intervals of time thereby activating and deactivating the alarm bells 42 over the same intervals of time to sound an alarm which is coded to identify to the workman the zone loop which is in alarm. Thus, the workman is immediately apprised at the device location (1) that the alarm condition has been detected at the central panel, and (2) that the alarm condition is associated with a particular zone loop, i.e., the zone loop to which the device is actually connected. If the zone loop identified by the alarm bells is the same as the one in the zone at which the workman is located, this indicates that the device in alarm has been connected in the correct zone loop. If the zone loop identified by the alarm bells is not the same as the one in the zone at which the workman is located, this indicates that the device in alarm has been improperly connected, i.e., that the device has been connected to the wrong zone loop. An exemplary audible code for identifying each of the zone loops, chosen for its simplicity and ability to be aurally recognized by the workman, is set forth in table 1 below.

TABLE 1

| Zone Loop | Audible Code Pattern |
|---|---|
| 1 | On-Off |
| 2 | On-Off-On-Off |
| 3 | On-Off-On-Off-On-Off |

TABLE 1-continued

| Zone Loop | Audible Code Pattern |
|---|---|
| 4 | On-Off-On-Off-On-Off-On-Off |

Each "on" interval, and each "off" interval between "on" intervals, would be one-half second long so as to ensure aural detection by the workman. Each code is stored in microprocessor memory and retrieved and outputted on the ALM RLY line based on the flag set by the microprocessor upon detection of an alarm condition. The appropriate audible code or pattern would be sounded once by the alarm bells 42 and then the alarm bells would be deactivated by the microprocessor (by deactivating alarm relay K1).

After the audible code or pattern is sounded, the microprocessor changes the condition of the DET RST output line so as to cut off transistor Q3 and transfer relay contacts K4C to the phantom position shown in FIG. 1C for a preset interval of time such as five seconds. This grounds all zone loops for the five second interval thereby resetting the devices in each loop and, in particular, the device which had been placed in alarm by the workman. Note that it is not necessary for the workman or a central panel operator to operate the alarm silence switch SW1 to silence the alarm bells 42 in the test mode of the present invention, as the microprocessor performs this function automatically after the appropriate audible code or pattern has been sounded once. In addition, it is not necessary for the workman or a central panel operator to operate the alarm reset switch SW2 since the microprocessor automatically resets the alarm devices after the audible code or pattern has been sounded. The microprocessor then returns to the start of the test mode program wherein it checks the ALARM 1–4 input lines for an alarm condition.

The workman then creates a trouble condition in the zone loop by opening the loop connection between adjacent devices. The trouble condition is detected at the TBL input to the microprocessor, and the microprocessor changes the state of the ALM RLY output in response for a preset interval of time (such as four seconds) so as to activate the alarm relay K1 (not trouble relay K2) for the four second interval. The relay contacts K1C, K1C' transfer to the phantom position shown in FIG. 1C for the four second interval so as to sound the alarm bells 42 continuously during the interval. The workman aurally detects the continuous alarm as indicating that the trouble condition has been properly detected.

The alarm bells 42 may be tested for a trouble condition in the same manner. The workman creates the trouble condition by opening the loop connection between adjacent alarm bells. The trouble condition is detected at the BELL TBL input to the microprocessor, and the microprocessor changes the state of the ALM RLY output in response for the preset (four second) time interval so as to sound the unaffected alarm bells continuously during the interval.

After testing a device, the workman proceeds to the next device in the zone loop until all devices in the loop have been tested for alarm and trouble conditions in the manner already described. Thereafter, the workman proceeds to the next loop and tests all devices in that loop, repeating the procedure as may be necessary until all devices in all zone loops have been tested.

For the purpose of illustrating the invention, there is shown in the drawings a form which is presently preferred; it being understood, however, that this invention is not limited to the precise arrangements and instrumentalities shown.

We claim:

1. Method of testing devices distributed throughout one or more zone loops remote from a central panel, comprising:

monitoring said devices in a test mode for an alarm condition, placing at least one of said devices in an alarm condition, detecting the alarm condition at the central panel and automatically sounding an audible on/off code which is aurally detectable at the location of the device placed in said alarm condition, said audible on/off code identifying the zone loop in which the device placed in said alarm condition is connected.

2. Method of testing devices distributed throughout one or more zone loops remote from a central panel, comprising:

monitoring said devices in a test mode for an alarm condition and a trouble condition, placing at least one of said devices in an alarm condition, detecting the alarm condition at the central panel and automatically sounding an audible on/off code which is aurally detectable at the location of the device placed in said alarm condition, said audible on/off code identifying the zone loop in which the device placed in said alarm condition is connected, creating a trouble condition in a zone loop, and detecting the trouble condition at the central panel and automatically sounding an audible alarm which is aurally detectable at the location of said last mentioned zone loop.

3. Method according to claims 1 or 2 including the step of automatically resetting the device placed in said alarm condition after said audible on/off code has been sounded.

4. Apparatus for testing devices distributed throughout one or more zone loops remote from a central panel, comprising:

means at the central panel for monitoring each of said devices in a test mode for an alarm condition, sounding means for sounding an alarm which is aurally detectable at the location of each of said zone loops, and means at the central panel for detecting a device in an alarm condition and for automatically causing said sounding means to sound an alarm which is coded so as to identify the zone loop in which said device in said alarm condition is connected.

5. Apparatus for testing devices distributed throughout one or more zone loops remote from a central panel, comprising:

means at the central panel for monitoring each of said devices in a test mode for an alarm condition, sounding means for sounding an alarm which is aurally detectable at the location of each of said zone loops, means at the central panel for detecting a device in an alarm condition and for automatically causing said sounding means to sound an alarm which is coded so as to identify the zone loop in which said device in said alarm condition is connected, and means at the central panel for detecting a trouble condition in a zone loop and for automatically causing said sounding means to sound an alarm which is coded to indicate detection of a trouble condition.

6. Apparatus according to claims 4 or 5 wherein said alarm which is coded to identify the zone loop is coded in an on/off code.

7. Apparatus according to claims 4 or 5 including means at said central panel for automatically resetting said device in said alarm condition after said coded alarm which identifies said zone loop has been sounded by said sounding means.

8. Apparatus according to claim 5 wherein said sounding means includes plural bells connected in a loop, and said means for detecting a trouble condition includes means for detecting a trouble condition in the bell loop and for automatically causing said sounding means to sound said alarm which indicates detection of a trouble condition in response.

9. Apparatus according to claims 5 or 8 wherein said alarm which is coded to indicate detection of said trouble condition is sounded continuously by said sounding means over a preset interval of time.

* * * * *